US006945002B2

(12) United States Patent
Zambelli et al.

(10) Patent No.: US 6,945,002 B2
(45) Date of Patent: Sep. 20, 2005

(54) REINFORCEMENT FOR PREFABRICATED CONCRETE PANELS WITH IMPROVED BONDING TO CONCRETE

(76) Inventors: Sergio Zambelli, Via Stezzano 28, 24050 Zanica (IT); Benito Zambelli, Via Roma 44, 24050 Zanica (IT)

( * ) Notice: Subject to any disclaimer, the term of this patent is extended or adjusted under 35 U.S.C. 154(b) by 373 days.

(21) Appl. No.: 09/742,560

(22) Filed: Dec. 22, 2000

(65) Prior Publication Data

US 2001/0015044 A1 Aug. 23, 2001

(30) Foreign Application Priority Data

Feb. 18, 2000 (IT) ..... MI2000A0287

(51) Int. Cl.[7] ..... E04C 5/03

(52) U.S. Cl. ..... 52/630; 52/601; 52/656.1; 52/729.3

(58) Field of Search ..... 52/414, 601, 630, 52/649.1, 653.1, 655.1, 656.1, 656.9, 800.12, 730.2, 712, 729.3, 745.19, 259

(56) References Cited

U.S. PATENT DOCUMENTS

| | | | | | |
|---|---|---|---|---|---|
| 3,395,438 | A | * | 8/1968 | Seeff | 428/604 |
| 3,442,056 | A | | 5/1969 | Lely | |
| 3,638,384 | A | * | 2/1972 | Martin | 52/592.1 |
| 3,760,540 | A | | 9/1973 | Latoria et al. | |
| 3,824,664 | A | * | 7/1974 | Seeff | 248/311.3 |
| 4,141,666 | A | * | 2/1979 | DeGraff | 405/126 |
| 4,235,024 | A | * | 11/1980 | Chauvin | 34/583 |
| 261,150 | A | * | 4/1981 | Sartorio | 52/405 |
| 4,598,747 | A | * | 7/1986 | Flechtner | 152/209.23 |
| 4,649,682 | A | * | 3/1987 | Barrett | 52/221 |
| 5,107,650 | A | * | 4/1992 | Patrick | 52/336 |
| 5,157,883 | A | * | 10/1992 | Meyer | 52/357 |
| 5,216,860 | A | * | 6/1993 | Thomson et al. | 52/259 |
| 5,287,672 | A | * | 2/1994 | Moore | 52/654.1 |
| 5,326,191 | A | * | 7/1994 | Wilson et al. | 405/124 |
| 5,619,837 | A | * | 4/1997 | DiSanto | 52/798.1 |
| 5,870,867 | A | * | 2/1999 | Mitchell | 52/220.1 |
| 6,125,603 | A | * | 10/2000 | Amore | 52/653.1 |
| 6,167,624 | B1 | * | 1/2001 | Lanahan et al. | 29/897.32 |
| 6,698,155 | B2 | * | 3/2004 | Menendez | 52/731.7 |

FOREIGN PATENT DOCUMENTS

| | | | |
|---|---|---|---|
| DE | 41 04 234 | 8/1992 | |
| EP | 0 381 000 | 8/1990 | |
| EP | 1126096 A2 * | 8/2001 | 52/649.7 |
| GB | 2 071 725 | 9/1981 | |
| WO | 93 12303 | 6/1993 | |

* cited by examiner

*Primary Examiner*—Winnie Yip
(74) *Attorney, Agent, or Firm*—Guido Modiano; Albert Josif; Daniel O'Byrne

(57) ABSTRACT

A reinforcement for prefabricated concrete panels with improved bonding with concrete, which comprises profiles to be embedded in a concrete body of a panel. At least some of the profiles have perforations and undulations which are suitable to increase the bonding between the profiles and the concrete body of the panel.

27 Claims, 5 Drawing Sheets

REINFORCEMENT FOR PREFABRICATED CONCRETE PANELS WITH IMPROVED BONDING TO CONCRETE

BACKGROUND OF THE INVENTION

The present invention relates to a reinforcement for prefabricated concrete panels with improved bonding to concrete.

Prefabricated concrete panels having a metallic reinforcement composed of longitudinal profiles, optionally connected to each other by transverse profiles, are known.

In such panels, the bonding between the concrete body of the panel and the metal profiles that constitute the reinforcement is crucially important, since the overall mechanical strength of the panel depends on this bonding.

Bonding between a metal profile and concrete is difficult to achieve, due to the fact that the profile has smooth flat surfaces arranged in a single unchanging direction and therefore they do not provide the concrete with any grip along such direction.

In order to solve this problem, reinforcements have been provided which are composed of profiles having perforations on their faces, for example as disclosed in EP 381,000 by the same Applicants, through which the concrete, during the manufacture of the panel, can pass, firmly anchoring the reinforcement in the panel body.

Over the years, this type of reinforcement has been modified in different ways, in order to further increase the bonding effect between the reinforcement and the concrete.

SUMMARY OF THE INVENTION

The aim of the present invention is to provide a reinforcement for prefabricated concrete panels which achieves high bonding to the concrete body of the panel, such panels having accordingly a greater mechanical strength and duration.

Within this aim, an object of the invention is to provide a reinforcement which effectively avoids decohesion even as a consequence of fatigue stresses, or if the reinforcement profiles are not perfectly clean when the panel is formed.

Another object of the invention is to provide a reinforcement which ensures excellent cohesion of the panel even in the presence of variously orientated stresses.

Another object of the invention is to provide a reinforcement which achieves adequate bonding with the concrete regardless of its formulation, particle size, thickness, density etcetera.

This aim and these and other objects which will become better apparent hereinafter are achieved by a reinforcement for prefabricated concrete panels, comprising profiles to be embedded in a concrete body of a panel, said profiles comprising longitudinal profiles and transverse profiles, said longitudinal profiles being reciprocally connected by means of said transverse profiles so as to form a frame, wherein at least some of said longitudinal profiles or said transverse profiles have perforation, and undulations which are suitable to increase the bonding between the reinforcement and the concrete body of the panel.

BRIEF DESCRIPTION OF THE DRAWINGS

Further characteristics and advantages of the invention will become better apparent from the description of a preferred but not exclusive embodiment of the reinforcement according to the invention, illustrated only by way of non-limitative example in the accompanying drawings, wherein.

DESCRIPTION OF THE PREFERRED EMBODIMENTS

Figure 1:
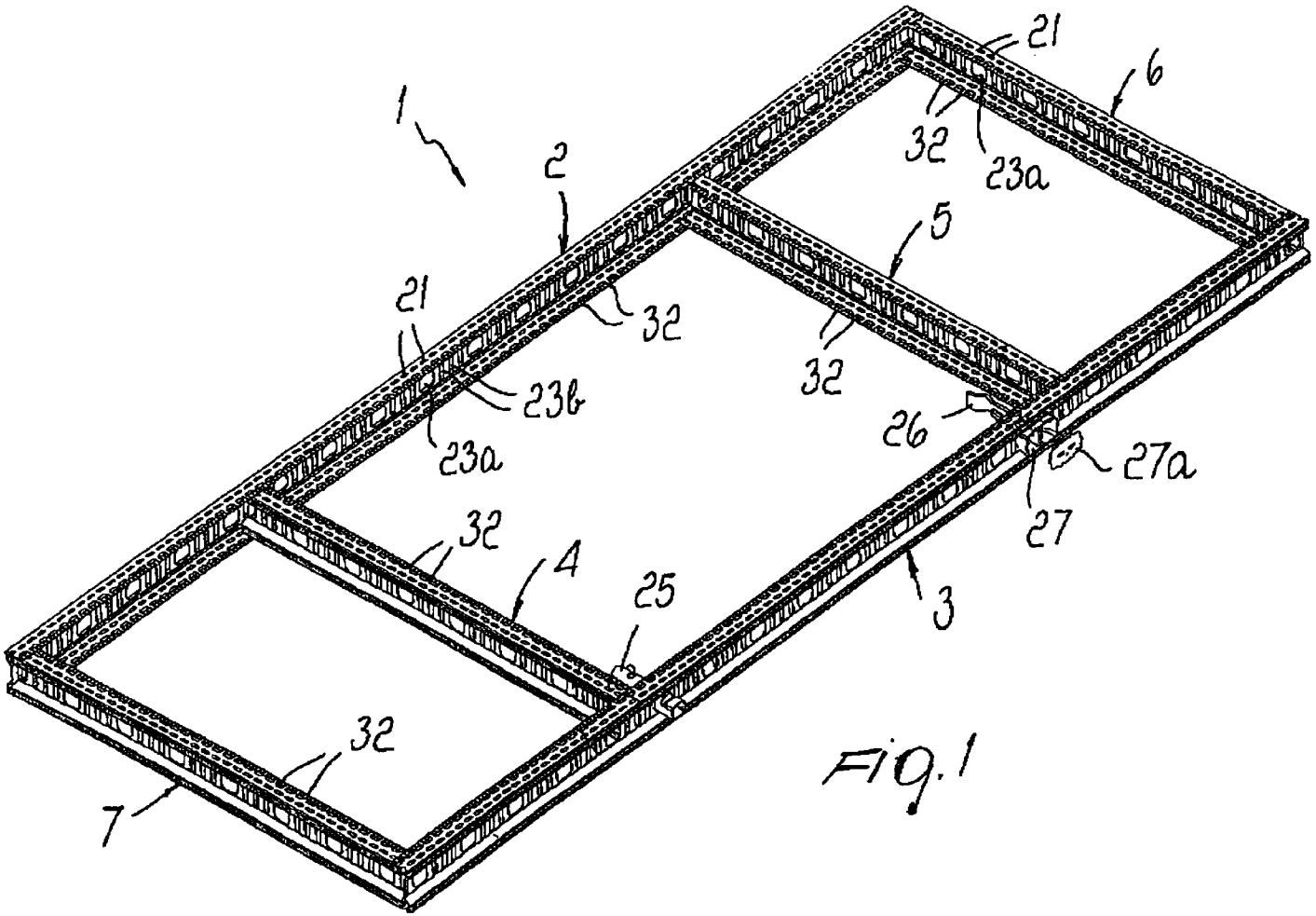
FIG. 1 is a perspective view of a reinforcement according to the invention.
Figure 2:
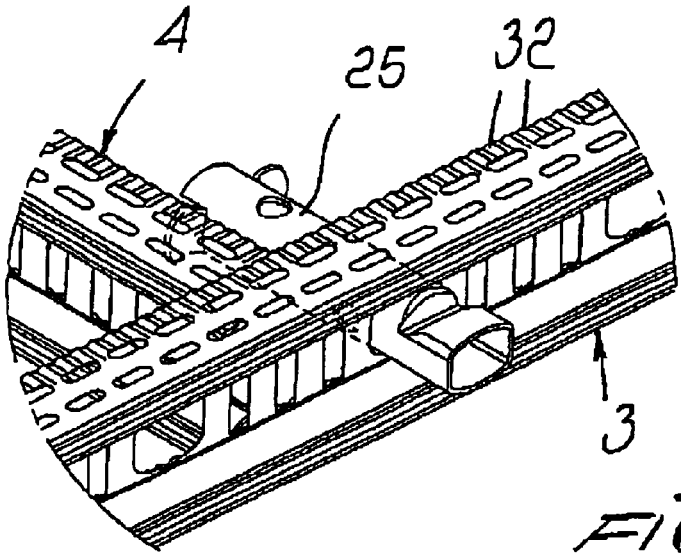
FIG. 2 is an enlarged-scale perspective view of a detail of FIG. 1.
Figure 3:
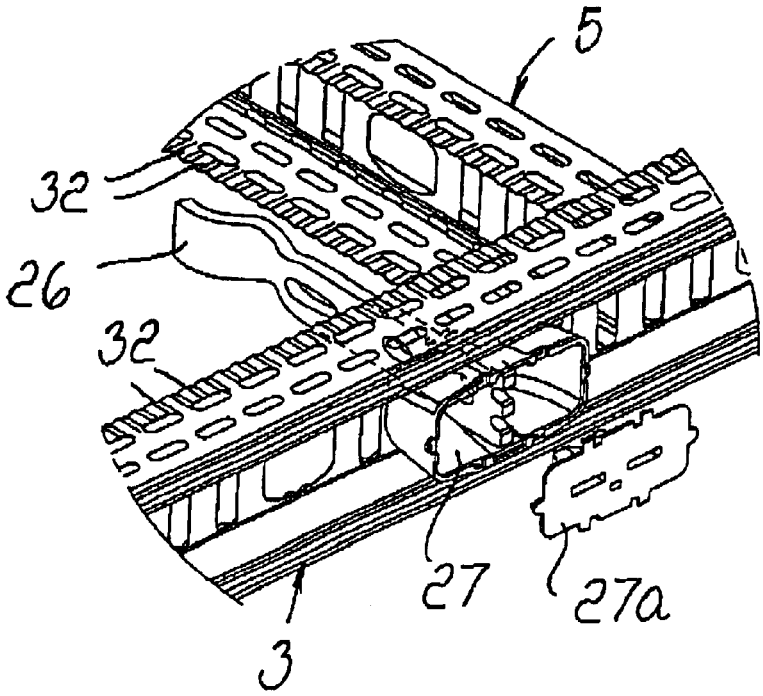
FIG. 3 is an enlarged-scale perspective view of another detail of FIG. 1.

With reference to the figures, the reinforcement according to the invention, generally designated by the reference numeral 1, comprises profiles 2–7 which are designed to be embedded into the concrete body of a panel.

preferably, the reinforcement 1 comprises a frame-like structure composed of longitudinal profiles 2 and 3, which are reciprocally connected by transverse profiles 4, 5, 6 and 7. Clearly, the number of longitudinal and transverse profiles can vary according to the requirements and to the dimensions of the panel to be provided.

Such profiles can have a substantially C-shaped transverse cross-section with two end wings 11 and 12 which are substantially parallel to each other and are joined by an intermediate wing 13.

Figure 5:
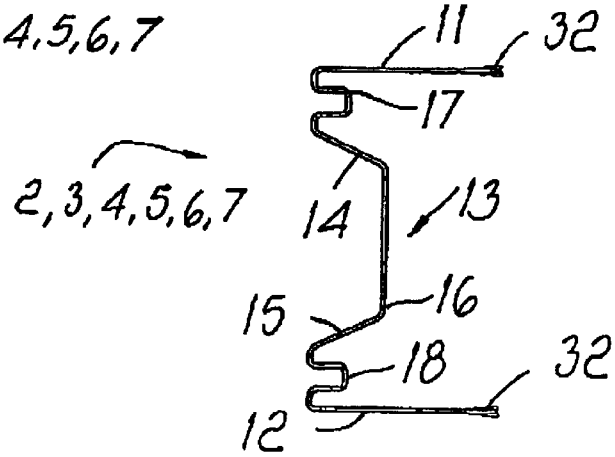
FIG. 5 is a transverse sectional view of the profile of FIG. 4, taken along the line V—V.

Preferably, such profiles have a substantially Σ-shaped transverse cross-section (see FIG. 5), with two end wings 11 and 12 which are substantially parallel to each other and are joined by an intermediate wing 13 having at least two portions 14 and 15 which are inclined with opposite inclinations.

In the illustrated embodiment, wing 13 has a central portion 16 and two end portions 17 and 18 being joined to the end wings 11 and 12. The portions 16, 17 and 18, except for a reinforcement fold provided in an intermediate region of the extension of the portions 17 and 18, lie on planes which are substantially perpendicular to the planes whereon the end wings 11 and 12 lie and they are reciprocally connected by the two inclined portions 14 and 15.

According to the invention, some or all of the profiles 2, 3, 4, 5, 6 and 7 that compose the reinforcement 1 have perforations or undulations which are suitable to increase bonding between the reinforcement and the body of the concrete of the panel.

More particularly, it is possible to provide preferably slotted perforations 21 which are possibly arranged along a plurality of rows on the two end wings 11 and 12 of the profiles.

It is also possible to provide perforations 22 in the end portions 17 and 18 of the intermediate wing 13.

Perforations 23*a*, alternated with groups of perforations 23*b*, can be provided also on the central portion 13 of the intermediate wing 16.

Some of the perforations 23*a* and 23*b* can be used to support accessories which are designed to be partly or fully embedded inside the concrete body of the panel and are used to lift or move the panel after its manufacture. Such accessories can be constituted by tubular bodies 25 if the lifting device is of the type disclosed in U.S. Pat. No. 6,092,849 by the same Applicants, or by plates 26 if the lifting device is of the type disclosed in U.S. Ser. No. 08/055,116 also by the same Applicants.

In the case of a tubular body 25, such body is inserted, before casting the body of the concrete, in a hole 23*a* which is adequately shaped so as to correspond to the tubular body 25.

In the case of lifting plates 26, such plates can instead be inserted in the rectangular perforations 23*b*.

Perforations 23*a* and 23*b* are of course alternated along the longitudinal extension of the profiles 2–7 so as to allow to position the accessories 25 and 26 in the chosen region.

Together with the plate 26, the reinforcement can support optional boxes 27 with the corresponding cover 27*a* for delimiting regions which must not be affected by the concrete casting that constitutes the body of the panel.

The undulations, according to requirements, can be formed on either coplanar portions or non-coplanar portions of the profiles. In particular, it is possible to provide undulations on the two end wings 11 and 12 in one or more regions and/or undulations on the portions 14, 15, 16, 17 and 18.

The undulations can be advantageously provided proximate to the free edges of the end wings 11 and 12 and/or can be provided between the perforations provided in these portions and in the other portions of the profiles.

Figure 7:
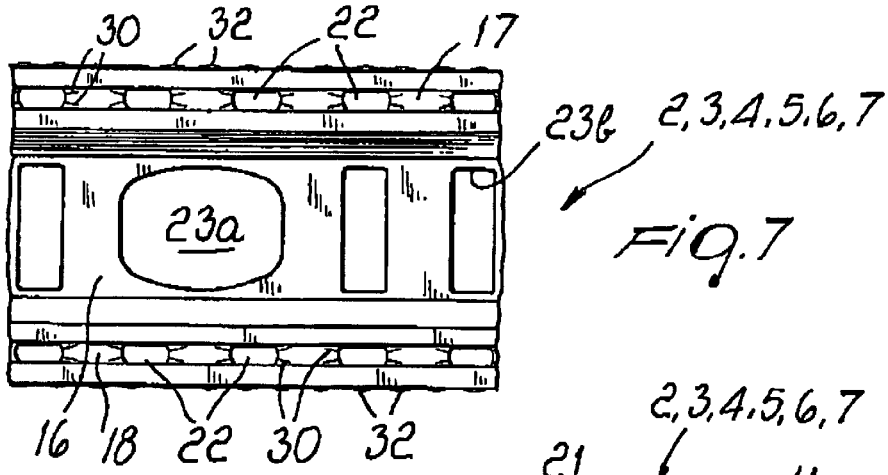
FIG. 7 is a side elevation view of the profile, illustrating a second embodiment of the undulations according to the present invention.

As shown in particular in FIG. 7, wherein the undulations have been designated by the reference numeral 30, the undulations may also be formed on the edges of the perforations 22 so as to arrange the edges of the perforations on different planes in order to affect larger concrete cross-sections at the perforations.

Figure 4:
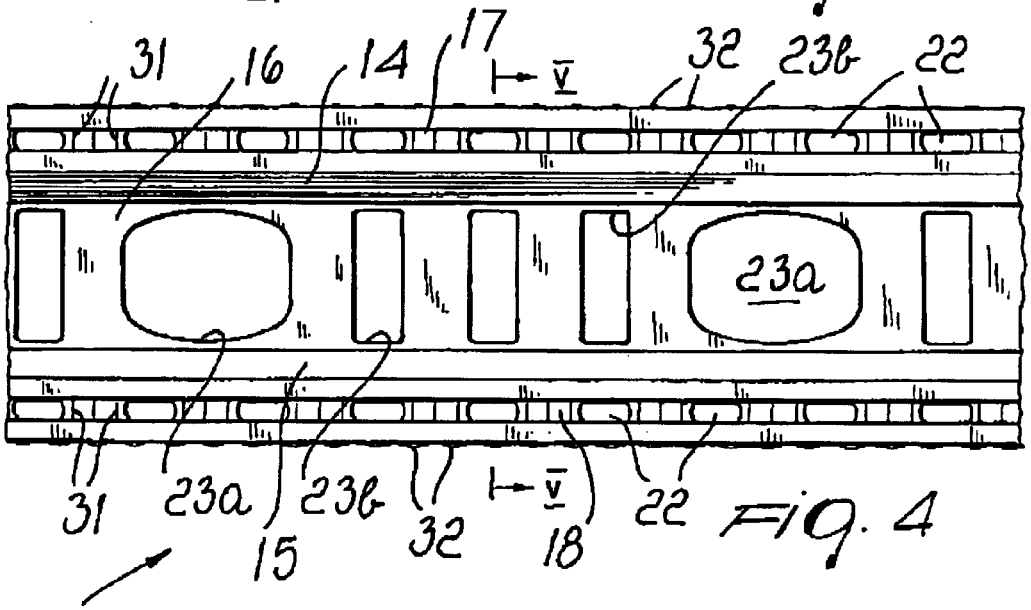
FIG. 4 is a side elevation view of a profile of the reinforcement according to the invention.

As shown in FIG. 4, the undulations, designated by the reference numeral 31, can simply be arranged between the perforations 22 without affecting their edge.

Figure 6:
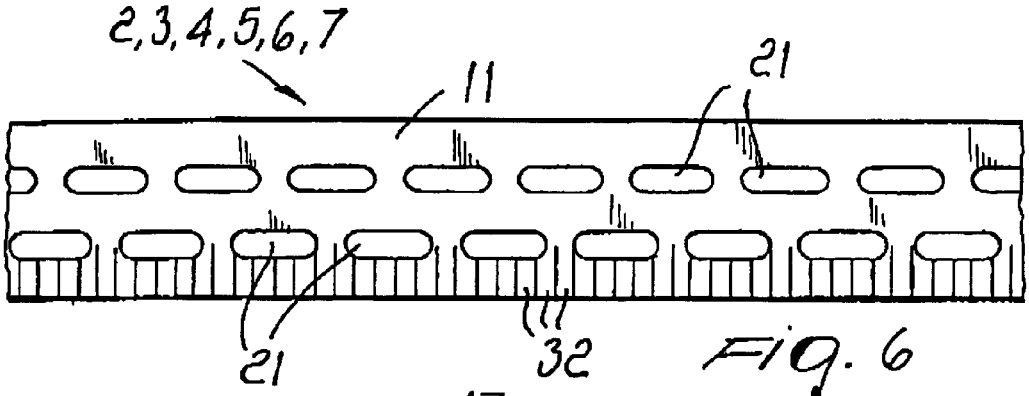
FIG. 6 is a top plan view of the profile of FIG. 4.
Figure 8:
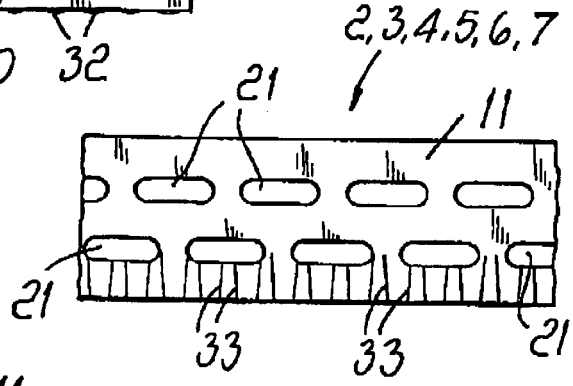
FIGS. 8 and 9 are top plan views of the profile, illustrating a third and a fourth embodiment of the undulations.
Figure 9:
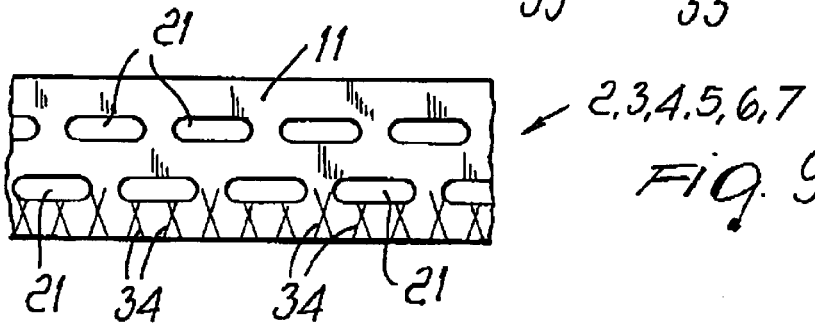

Conveniently, as shown in particular in FIG. 6, the undulations, designated by the reference numeral 32, can have parallel sides or, as shown in FIG. 8, in which said undulations are designated by the reference numeral 33, can have sides which are inclined with respect to each other, or also, as shown in FIG. 9, in which the undulations have been designated by the reference numerals 34, can have intersecting sides.

Figure 11:
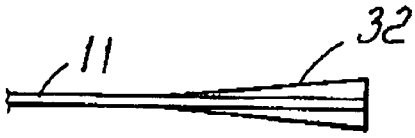
FIGS. 10 and 11 are enlarged-scale transverse sectional views of the profile, illustrating two possible shapes of the undulations.
Figure 10:
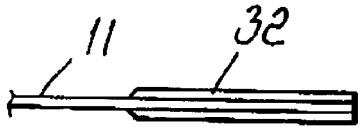
Figure 12:
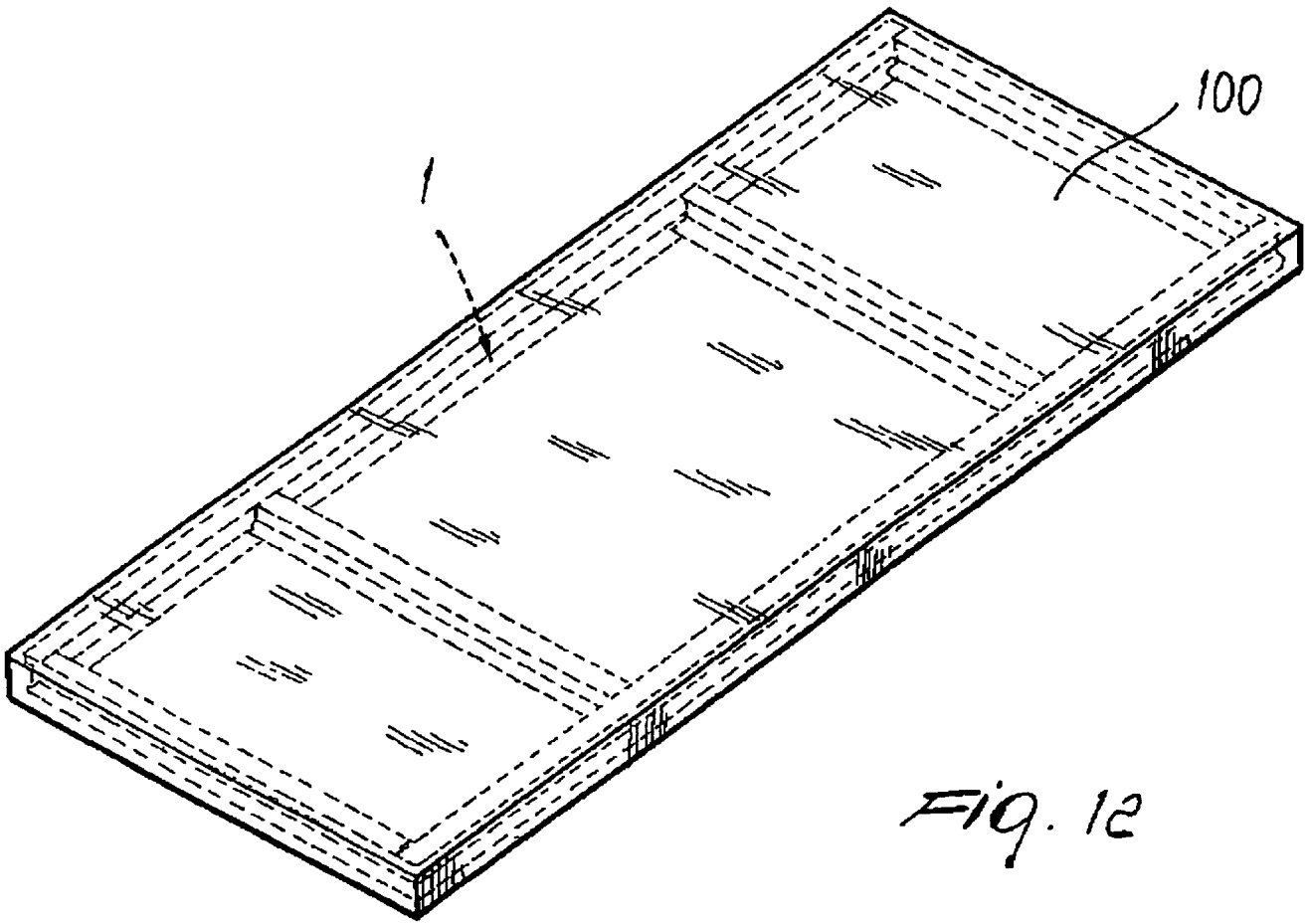
FIG. 12 is a perspective view of a concrete panel with a profile embedded.

According to requirements, as shown in FIG. 10, the undulations 32, 33, 34 can have a constant height or depth or, as shown in FIG. 11, can have a height or depth which increases toward the edges of the profiles.

If the panel to be manufactured is very thick, the frame-like structure of the reinforcement according to the invention can have longitudinal and/or transverse sides which are constituted by two or more of the above described profiles, coupled by means of two end wings thereof, i.e., by two or more superimposed profiles, so as to achieve the intended thickness for the panel to be provided. In this manner it is possible to meet various thickness requirements for the panel with a reduced range of profile types.

The profiles 2–7 are preferably made of metal and the undulations are constituted by plastic deformations of such profiles.

In practice it has been observed that the reinforcement according to the invention fully achieves the intended aim and objects, since the presence of the perforations, combined with the presence of the undulations, interrupts the continuity of the profiles and alters the planar profile of the faces of the profiles, thus achieving high bonding of the reinforcement to the concrete constituting the body of the panel.

In particular, the undulations, by affecting coplanar portions and variously inclined portions of the profiles, ensure high bonding between the reinforcement and the concrete regardless of the orientation of the stresses to which the panel is subjected. This achieves greater strength and longer life of the panel.

The reinforcement thus conceived is susceptible of numerous modifications and variations, all of which are within the scope of the appended claims; all the details may further be replaced with other technically equivalent elements.

In practice, the materials used, so long as they are compatible with the specific use, as well as the dimensions, may be any according to requirements and to the state of the art.

What is claimed is:

1. A reinforcement for prefabricated concrete panels, comprising profiles adapted to be connected together to form a frame and adapted to be embedded in a concrete body of a panel, said profiles having coplanar and non-coplanar portions, at least some of said profiles having perforations and undulations which are suitable to increase the bonding between the reinforcement and the concrete body of the panel, wherein said profiles have each a substantially Σ-shaped transverse cross-section, with two substantially parallel end wings joined by an intermediate wing which has at least two portions inclined with opposite inclinations, wherein said profiles are made of metal and said undulations are formed by plastic deformations of said profiles, said undulations being defined at the end of said and wings so as to face one another.

2. The reinforcement according to claim 1, wherein said intermediate wing has a central portion and two end portions which are joined to said end wings and are arranged on planes substantially perpendicular to the planes on which said end wings are arranged, said central portion being connected to said end portions by said two inclined portions.

3. The reinforcement according to claim 1, comprising a frame which is composed of longitudinal profiles which are reciprocally connected by transverse profiles, at least some of said profiles of the frame having said perforations and undulations suitable to increase the bonding between said profiles and the concrete body of the panel.

4. The reinforcement according to claim 1, wherein said undulations are comprised on non-coplanar portions of said profiles.

5. The reinforcement according to claim 1, wherein said undulations are comprised on coplanar portions of said profiles.

6. The reinforcement according to claim 1, wherein said undulations are comprised on regions between said perforations.

7. The reinforcement according to claim 1, wherein said undulations are comprised on an edge of said perforations.

8. The reinforcement according to claim 1, wherein said undulations have a constant height.

9. The reinforcement according to claim 1, wherein said undulations have a height or depth which increases toward the edges of the profiles.

10. The reinforcement according to claim 1, wherein said undulations have parallel sides.

11. The reinforcement according to claim 1, wherein said undulations have sides which are inclined with respect to each other.

12. The reinforcement according to claim 1, wherein said undulations have intersecting sides.

13. The reinforcement according to claim 3, wherein in said frame at least longitudinal sides thereof are constituted by two of said profiles which are coupled by means of two end wings thereof.

14. A prefabricated concrete panel, comprising the reinforcement according to claim 1.

15. A reinforcement for prefabricated concrete panels, comprising profiles to be embedded in a concrete body of a panel and adapted to be connected to compose a frame, said profiles having coplanar and non-coplanar portions, at least some of said profiles having perforations and undulations which are suitable to increase the bonding between the reinforcement and the concrete body of the panel, wherein said undulations are comprised on non-coplanar portions of said profiles and are arranged at the end of portions of said profile that face one another, wherein said profiles are made of metal and said undulations are formed by plastic deformations of said profiles.

16. The reinforcement according to claim 15, comprising a frame which is composed of longitudinal profiles which are reciprocally connected by transverse profiles, at least some of said profiles of the frame having said perforations and undulations suitable to increase the bonding between said profiles and the concrete body of the panel.

17. The reinforcement according to claim 15, wherein said profiles have a substantially C-shaped transverse cross-section, with two substantially parallel end wings joined by an intermediate wing.

18. The reinforcement according to claim 15, wherein said profiles have each a substantially Σ-shaped transverse cross-section, with two substantially parallel end wings joined by an intermediate wing which has at least two portions inclined with opposite inclinations.

19. The reinforcement according to claim 15, wherein said undulations are comprised on regions between said perforations.

20. The reinforcement according to claim 15, wherein said undulations are comprised on an edge of said perforations.

21. The reinforcement according to claim 15, wherein said undulations have a constant height.

22. The reinforcement according to claim 15, wherein said undulations have a height or depth which increases toward the edges of the profiles.

23. The reinforcement according to claim 15, wherein said undulations have parallel sides.

24. The reinforcement according to claim 15, wherein said undulations have sides which are inclined with respect to each other.

25. The reinforcement according to claim 15, wherein said undulations have intersecting sides.

26. The reinforcement according to claim 17, wherein in said intermediate wing there are perforations which are suitable to support inserts which can be embedded in the concrete body of the panel end can be used to lift said panel.

27. A prefabricated concrete panel, comprising the reinforcement according to claim 15.

* * * * *